US007396303B2

(12) United States Patent
Gazzara et al.

(10) Patent No.: US 7,396,303 B2
(45) Date of Patent: Jul. 8, 2008

(54) SPORTS RACQUET WITH INSERT MEMBERS FOR ANCHORING STRINGS

(75) Inventors: Roberto Gazzara, Mestre (IT); Mauro Pinaffo, Camposampiero (IT); Michele Pozzobon, Fossalunga di Vedelago (IT); Mauro Pezzato, Treviso (IT)

(73) Assignee: Prince Sports, Inc., Bordentown, NJ (US)

( * ) Notice: Subject to any disclaimer, the term of this patent is extended or adjusted under 35 U.S.C. 154(b) by 0 days.

(21) Appl. No.: 11/872,770

(22) Filed: Oct. 16, 2007

(65) Prior Publication Data

US 2008/0058131 A1 Mar. 6, 2008

Related U.S. Application Data

(63) Continuation of application No. 11/584,199, filed on Oct. 20, 2006, now abandoned.

(30) Foreign Application Priority Data

Nov. 29, 2005 (EP) ..... 05111453

(51) Int. Cl.
*A63B 49/02* (2006.01)
*A63B 51/00* (2006.01)

(52) U.S. Cl. ..... 473/539; 473/540

(58) Field of Classification Search ..... 473/520–522, 473/524, 539, 540, 542, 543, 553
See application file for complete search history.

(56) References Cited

U.S. PATENT DOCUMENTS

| | | | |
|---|---|---|---|
| 2,230,177 | A | 1/1941 | Percy |
| 3,545,756 | A | 12/1970 | Nash |
| 3,702,701 | A | 11/1972 | Vaughn et al. |
| 3,901,507 | A | 8/1975 | Santini-Ormieres et al. |
| 4,182,512 | A | 1/1980 | Kuebler |
| 4,206,917 | A | 6/1980 | Guillem et al. |
| 4,394,014 | A | 7/1983 | Balaban |
| 5,060,944 | A | 10/1991 | Janes |
| 5,435,550 | A | 7/1995 | You |
| 5,467,982 | A | 11/1995 | Tseng |
| 6,527,656 | B1 | 3/2003 | Cheng et al. |
| 6,964,624 | B2 | 11/2005 | Shen et al. |
| 2005/0153799 | A1 | 7/2005 | Rigoli |
| 2006/0172828 | A1 | 8/2006 | Pezzato et al. |
| 2007/0123377 | A1 | 5/2007 | Gazzara et al. |

FOREIGN PATENT DOCUMENTS

| | | | |
|---|---|---|---|
| FR | 2587626 | A | 3/1987 |
| WO | 9426361 | A | 11/1994 |

OTHER PUBLICATIONS

European Search Report for case EP 05111453, which is the European counterpart of the parent application, 11/ 584, 199, Mar. 2006.

*Primary Examiner*—Raleigh W. Chiu

(57) ABSTRACT

The sides of a sports racquet, and optionally the tip and throat bridge, include axially extending cutout portions. An insert member, having a plurality of string port holes and optionally conventional string holes, is seated in each cutout portion. The frame and insert member are preferably formed of different materials.

11 Claims, 13 Drawing Sheets

SPORTS RACQUET WITH INSERT MEMBERS FOR ANCHORING STRINGS

RELATED APPLICATIONS

This is a continuation of application Ser. No. 11/584,199, filed Oct. 20, 2006, entitled "Sports Racquet With Insert Members For Anchoring Strings"

BACKGROUND OF THE INVENTION

The present invention relates to sports racquets, for example tennis, squash, badminton, and racquetball racquets. Such racquets have a head portion containing an interwoven string bed, a handle, and a shaft portion connecting the head portion to the handle.

Most high performance sports racquets have a frame molded from composite materials, e.g., a carbon fiber-reinforced resin. Holes for anchoring the ends of the strings are drilled through the frame after the racquet is molded. Plastic grommet pegs, which are formed on a grommet strip or bumper strip that rests against the outside surface of the frame, extend through the string holes to protect the strings from the sharp edges of the drilled holes.

Proposals have been made to form string holes during the molding process. For example, commonly owned U.S. Pat. No. 6,800,239 discloses a racquet made of two frame tubes, in which the string holes are formed during the molding process using a plurality of hole-forming pins positioned within the mold between the two tubes. Such racquet has the advantage that it does not require drilling holes through the material, which can weaken the frame. Moreover, the two tubes press against one another during molding, forming an interior support wall, which further strengthens and stiffens the racquet.

Commonly owned PCT application WO 2004/075996 discloses another sports racquet in which the string holes are molded-in. In this racquet, however, pairs of adjacent conventional string holes are replaced with a single enlarged string hole, the opposite sides of which accommodate two strings. Such process allows the weight of the racquet head to be reduced and, as in the case of the '239 patent, tends to produce a frame which is stiffer and stronger than one in which string holes are drilled through the frame after molding.

In racquet sports, there is no single ideal racquet. Different players need racquets with different playing characteristics. For example, beginners, intermediate players, and advanced players each tend to prefer racquets with different playing characteristics. Also, a player's choice of racquet tends to vary depending upon the player's type of swing and playing style. Serve-and-volley players may prefer racquets with far different playing characteristics than racquets preferred by baseline players.

Once a racquet has been designed and built, it is difficult to alter its playing characteristics to any significant degree. Its overall weight, stiffness, balance, mass and polar moments of inertia, sweet spot, and coefficient of restitution are determined principally by the design of the frame, choice of material, the fiber orientation of the various plies of material forming the frame, and the number and placement of the string holes. The weight, balance, and moments of inertia can be modified to some degree by using special tapes positioned at certain racquet locations, or by attaching removable parts. However, such measures make the racquet heavier than its original design, which is normally undesirable. Moreover, the frame stiffness and the stringing pattern of the racquet cannot be changed after the racquet has been molded and the string holes formed. In order to substantially modify the playing characteristics of an existing racquet model, the racquet frame would have to be redesigned.

In order to satisfy a range of player needs, manufacturers currently are forced to offer many different racquet models. It would be desirable to provide a racquet whose playing characteristics can be customized after the racquet is manufactured in order to reduce the number of racquet models while still providing a wide range of playing characteristics.

BRIEF SUMMARY OF THE INVENTION

The present invention is an improved sports racquet, e.g., a tennis, squash, badminton, or racquetball racquet. In one embodiment according to the present invention, along the sides of the racquet frame, and optionally in the tip region and throat bridge, the racquet frame includes elongated cutout portions that extend through the frame to provided openings in the string bed plane. Each cutout portion includes a seat surface. A separate insert member containing string holes is positioned in each cutout portion and includes a bearing surface which bears against the seat surface when the strings are tensioned, to secure the ends of the strings in place.

Preferably, the insert members are removably positioned in the cutout portions, and can be replaced with different insert members, e.g., of different weights or with different string hole spacing, in order to modify the playing characteristics of the racquet or change the string bed pattern. If desired, racquet frames may be offered by retailers along with a selection of insert members, from which the customer or a club professional can choose prior to stringing. If desired, the racquet may be sold with two or more sets of insert members, allowing the customer to switch when the racquet is re-strung.

In a preferred embodiment, each insert member has at least one enlarged string hole for seating two adjacent main or cross strings (herein referred to as a "string port hole"). The frame and insert member are preferably formed of different materials.

Preferably, the frame is formed of conventional composite material, but it is possible to use other materials such as metal. The insert members may be formed of carbon fiber-reinforced composites, metal, wood, ceramic, plastic or another suitable material, or a combination thereof, the principal criteria being that the insert members must be strong enough to anchor the ends of the strings. The choice of material depends largely on the desired weight and flexibility of the insert members.

The use of insert members provides flexibility in customizing the playing characteristics of the racquet, insofar as it allows the player easily to vary a number of playing characteristics of the racquet, including: mass, balance, polar and mass moments of inertia, stiffness, and vibration and shock absorption. The player can also change the relative spacing of the strings in the string bed, to vary its playing characteristics. Thus, the player can readily customize the racquet to suit his or her playing abilities and preferences.

The invention further allows the player to vary the appearance of the racquet, e.g., by using insert members having different colors or different outer surface designs.

The invention also simplifies the frame construction process, in that it does not require molding in string holes, or drilling individual string holes after the racquet has been molded. It also simplifies the painting process, reducing production cost.

Preferably each insert member includes a plurality of adjacent string port holes. The insert member may also include one or more conventional string holes.

The string port holes on opposite sides of the frame (as well as the opposed string port holes in the tip and throat bridge, if present) are offset relative to one another such that a string that bears against an upper surface of a string port hole on one side of the racquet, after crossing the string bed, bears against a lower surface of a port on the opposite side of the racquet.

The string port holes can have any suitable shape, such as elliptical, circular, polygonal, rounded, convex, concave, or irregular. The use of string port holes allows the overall weight of the racquet to be reduced and makes stringing easier. Examples of suitable string port holes are disclosed in WO 2004/075996, the disclosure of which is incorporated by reference.

Preferably, all of the string ends are anchored in string holes in the insert members. Preferably, the throat bridge has forked ends to define an opening in the string bed plane to allow outer main strings to pass through the throat bridge to string holes in the side insert members. Thus, in such embodiment the openings and insert members extend down the racquet frame to a point below the ends of the throat bridge.

In one embodiment, the racquet is formed by molding two tubes of prepreg material in accordance with a process as generally described in U.S. Published Patent Application No. US 2003/0162613, the disclosure of which is incorporated by reference. In the process described in the aforementioned publication, the two tubes form an upper and lower frame half, respectively, of the frame. String holes of conventional size are formed between the common wall of two tubes by positioning a plurality of metal pins between the facing walls of the upper and lower tubes prior to the molding process. The pins are then removed after the frame has been molded, leaving molded string holes.

In the present case, instead of pins, molding elements in the shape of the cutout are positioned between the upper and lower tubes prior to molding. Thus, the cutouts are formed by the two spaced apart, closed tubular portions to keep out dirt and water.

Other features and advantages of the invention will become apparent from the following description of preferred embodiments, taken in conjunction with the drawings.

DETAILED DESCRIPTION OF THE INVENTION

Figure 1:
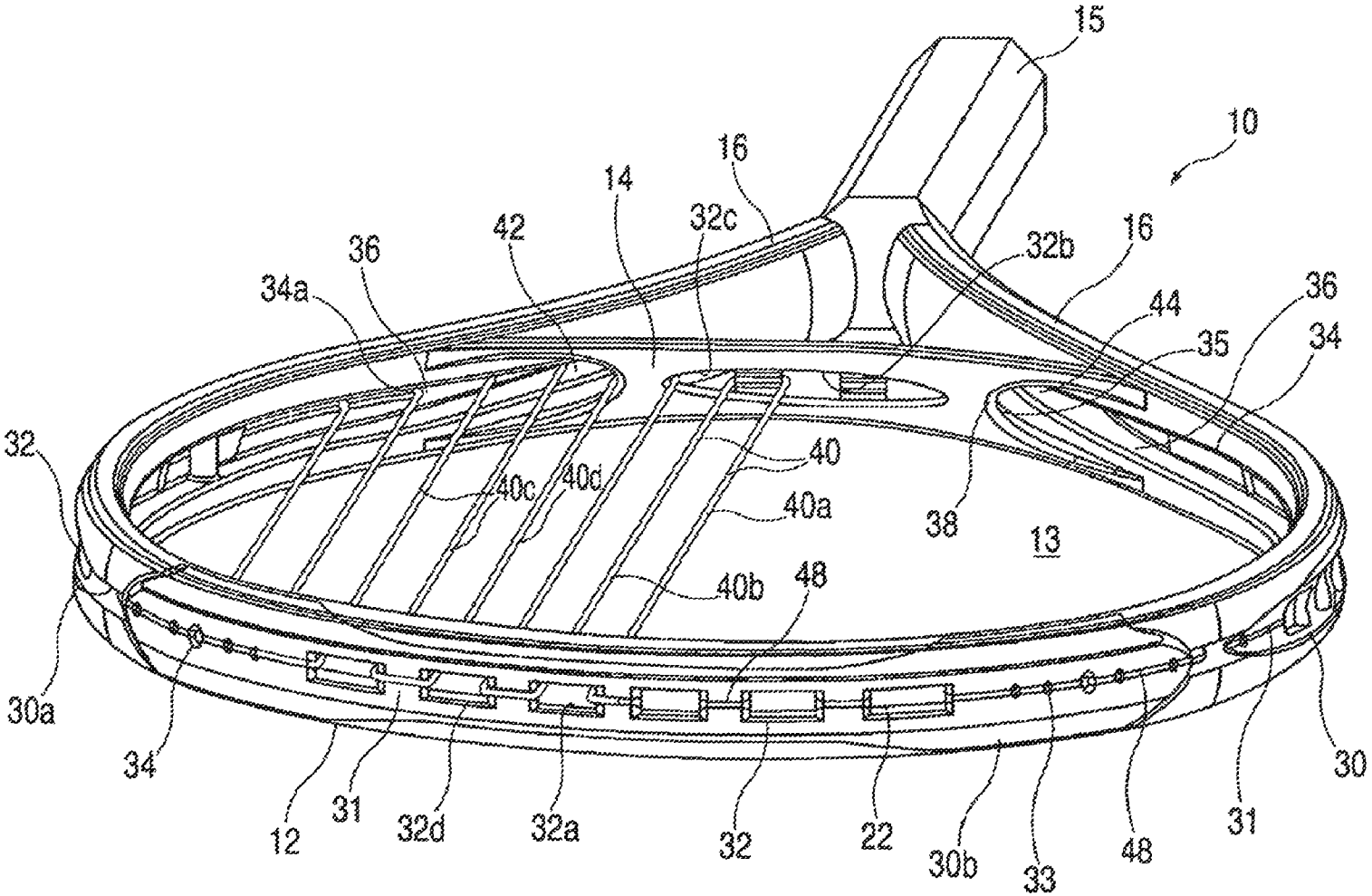
FIG. 1 is a perspective view of a partially strung tennis racquet frame according to a first embodiment of the invention.

FIG. 1 illustrates a partially strung tennis racquet frame 10. The frame includes a head portion 12, whose inwardly facing surface defines an area 13 in which the string bed lies. The head portion includes a throat bridge 14 which encloses the lower portion of the stringing area 13. The head portion is coupled to a handle portion 15 of the frame by a pair of converging shaft members 16.

Figure 2:
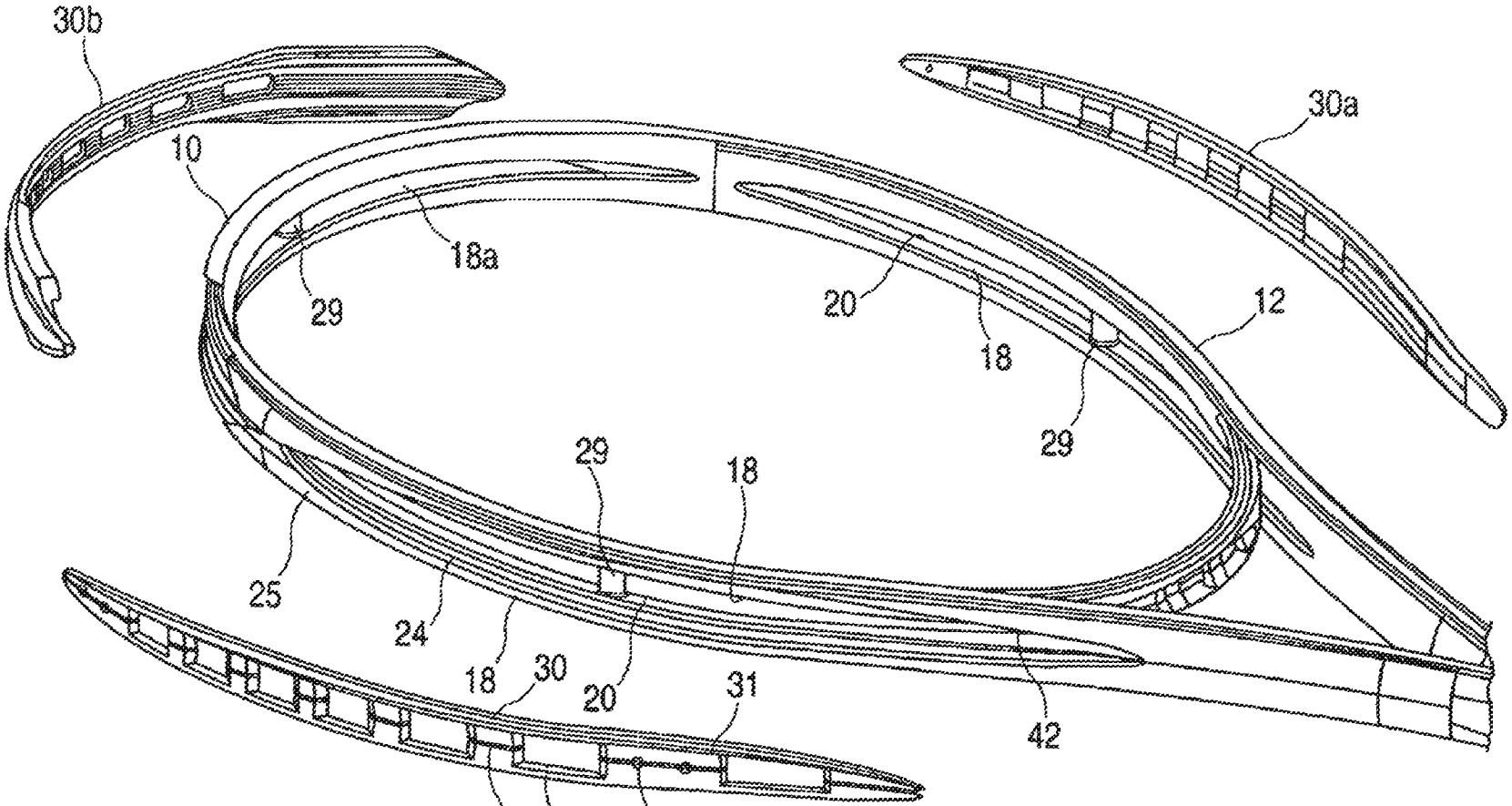
FIG. 2 is a perspective, exploded view of the tennis racquet frame and insert pieces of FIG. 1 prior to stringing.

As shown in FIG. 2, the head portion 12 of the frame includes elongated cutout portions 18, 18*a*. A cutout portion 18 is formed along each of the sides of the head section 12. A third cutout portion 18*a* is formed in the tip section.

Each cutout portion 18, 18*a* includes a slot 20 that extends through the frame 10 in the plane of the string bed, and an outwardly facing shoulder 24 surrounding the slot 20. The shoulder 24, which acts as a bearing surface, is depressed relative to the outer surface 26 of the frame 10 and, at each location on the frame, is preferably perpendicular to the direction of the strings entering and leaving the frame. Alternatively, the shoulder 24 may be at an angle other than perpendicular. For example, the shoulder 24 could taper inwardly in the direction toward the string bed.

If desired, one or more support posts 29 may span the upper and lower frame portions defining the cutout portions 18, 18*a*.

Insert members 30, 30*a*, 30*b* are received in the cutout portions 18, 18*a*. The undersurface of each insert member 30, 30*a* bears against the shoulder 24. In a preferred embodiment, the insert members 30, 30*a*, 30*b* have a thickness such that their outer surface 31 is generally flush with the outer surface 25 of the frame. However, if desired, the outer surfaces 31 of the insert members may lie above or below the outer surface 25 of the frame. In the example shown, where the shoulder 24 is perpendicular to the direction of the string passing through the frame, the corresponding bearing surfaces of the insert members 18, 18*a* are flat. If the shoulder 24 is tapered or otherwise shaped, the corresponding insert member bearing surface would be tapered or have a corresponding shape. In either case, the function of the bearing surfaces is to prevent the insert members 18, 18*a* from being pulled through the frame when the strings are tensioned.

Each insert member 30, 30*a*, 30*b* includes a plurality of string port holes 32 and a plurality of conventional string holes 33. Each of the string port holes 32, 32*a* provides for the passage of two contiguous main string segments or two contiguous cross string segments and has a dimension equal to the desired spacing between two contiguous string segments. As used herein, the term "string segment" refers to a length of string extending between opposed string holes on the frame.

Preferably, the center region of the throat bridge 14 is molded to include a plurality of string port holes 32*a*, and the opposite ends 35 of the throat bridge are forked to define openings 36 in the plane of the string bed for the passage of the outer main strings 40.

The string port holes 32 on opposite sides of the racquet frame are offset relative to one another such that a string extending from one side of a string port hole 32, after crossing the interwoven string bed, extends along the opposite side of the string port hole 32 on the opposite side of the racquet. The same is true of the string port holes in the tip region and throat bridge.

Figure 3:
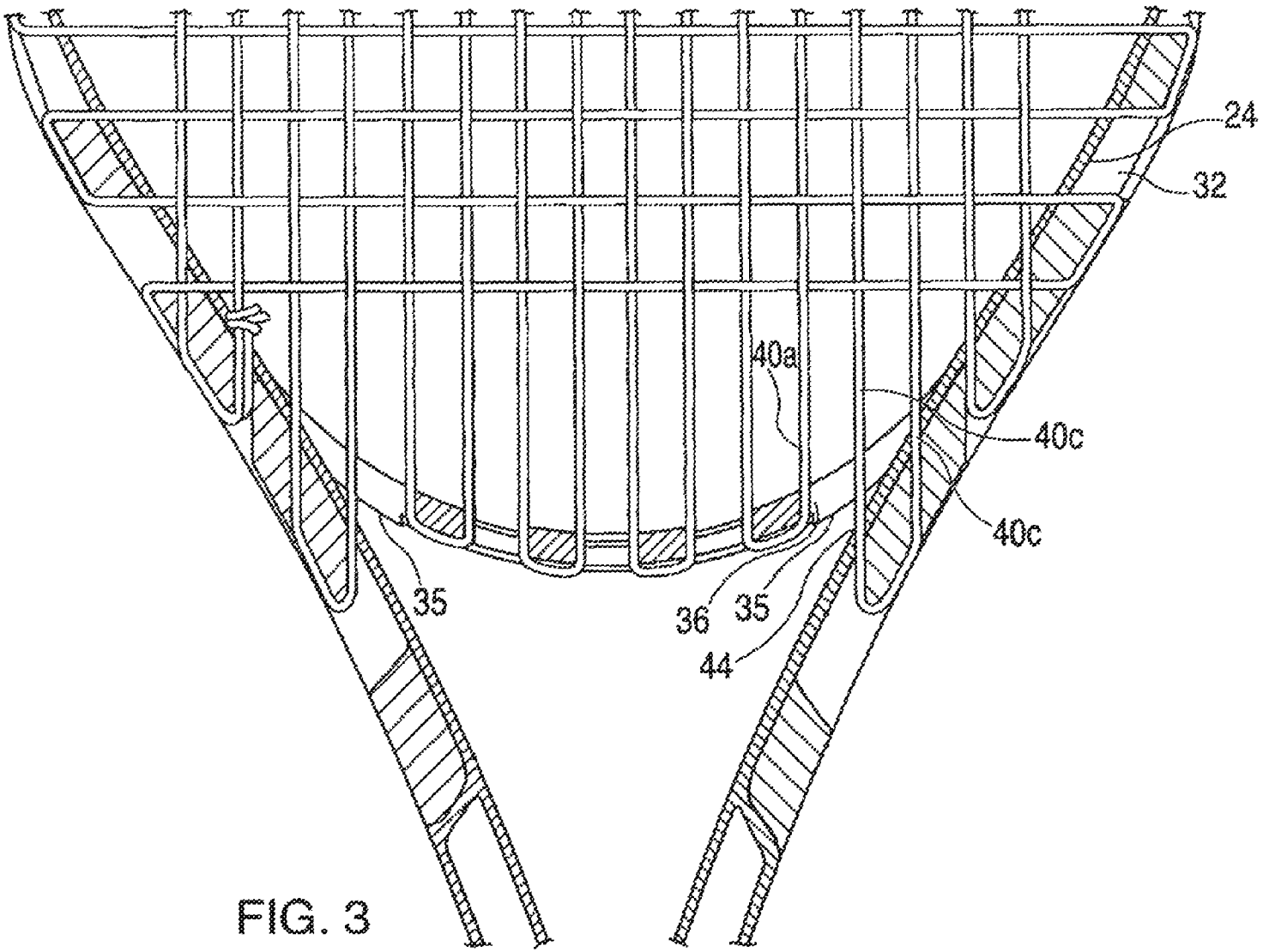
FIG. 3 is a sectional plan view of a portion of the frame of FIG. 1 after stringing.
Figure 4:
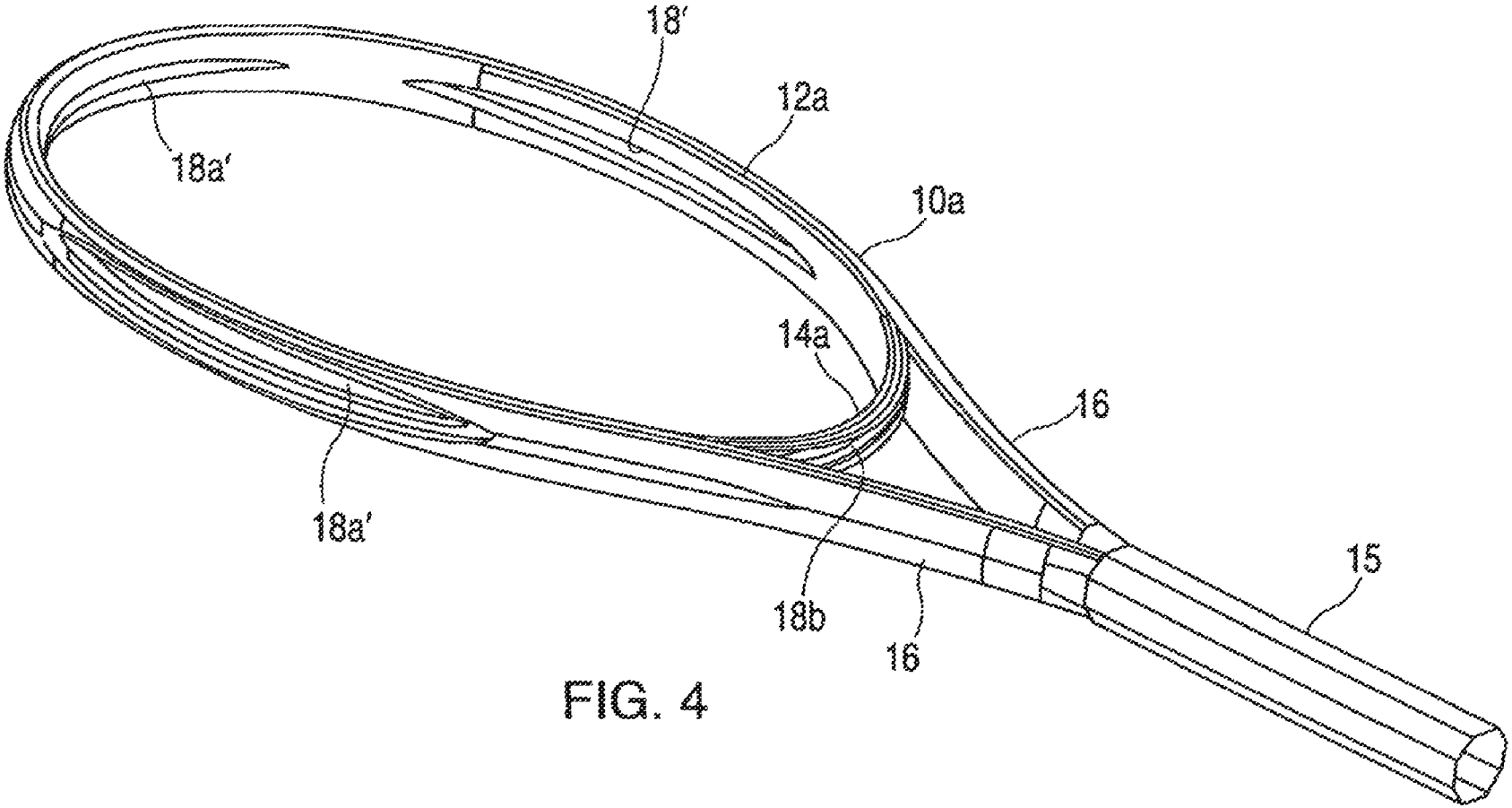
FIG. 4 is a perspective view of a racquet frame according to a second embodiment of the invention.
Figure 5:
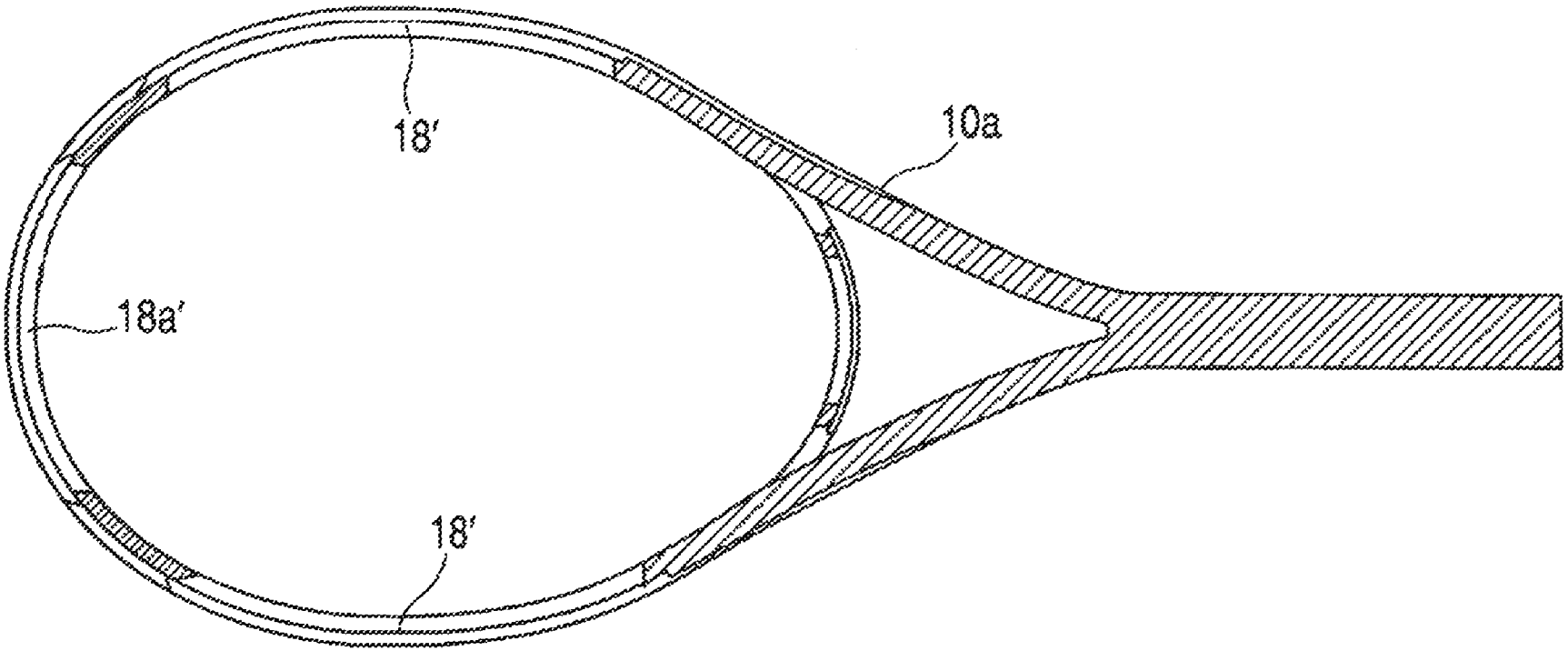
FIG. 5 is a longitudinal, sectional view of the frame of FIG. 4.
Figure 6:
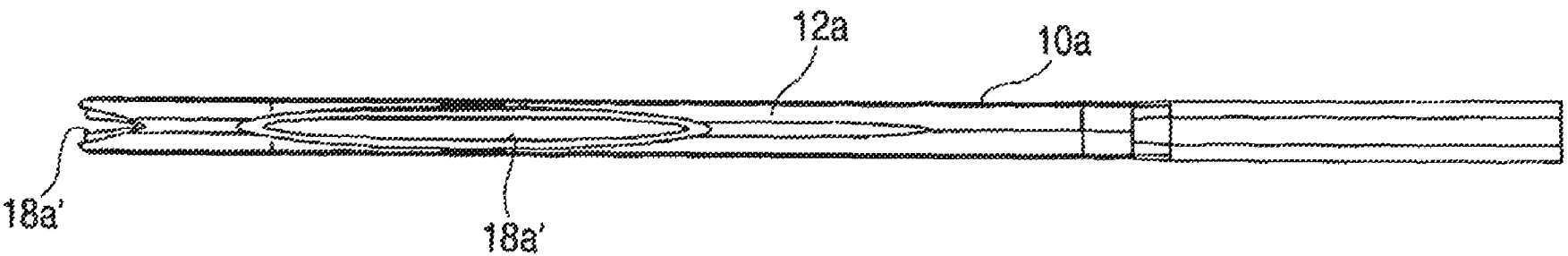
FIG. 6 is a side view of the racquet frame of FIG. 4.

In the example shown in FIGS. 1-3, the insert members 30, 30*a* along the sides contain seven string port holes 32 along with conventional string holes 33. The insert member 30*b* at the tip contains six string port holes 32 along with conventional string holes 33. However, FIGS. 1-3 are merely exemplary, and the disposition, and number of string port holes 32 and conventional string holes 33 can vary.

In the example of FIGS. 1-3, the string port holes 32 are rectangular in shape. However, the string port holes may assume any suitable shape, e.g., any of the shapes shown in WO 2004/075996. The shape of the string port holes can be varied in order to create different design patterns in the frame or for other reasons, such as minimizing the cost of tooling or production. Preferably, the outer edges of the string port holes, at least in the string plane, are rounded, so that the string does not encounter a sharp edge as it enters and leaves the hole and form a guide anchoring the ends of the strings.

The outside surfaces of the insert members include a stringing groove 48, to help guide the strings between string holes, and anchor the ends of the string segments in the holes. Preferably, the surfaces of the string port holes against which the strings bear as they pass through is flat, as shown in FIGS. 1 and 3, and oriented so as to be perpendicular to the string bed and parallel to the direction by which the string end passes through the string port hole. This provides two advantages. First, when a ball impacts the string bed, because the end of the string segment is constrained against movement only along the outside of the frame, the string segment is free to pivot from the outside of the frame, increasing the effective length of the string. Second, after the ball has left the string bed, the end of the string segment will rub against the string hole port surface, thereby damping string vibration.

The string port holes can also be used as seats for the insertion of plastic parts and/or vibration damping elements and/or weights in order to modify the mass distribution of the frame, for example, to change the balance or playing characteristics of the racquet.

FIG. 1 shows a partially strung racquet in order to illustrate why the port string holes need to be offset relative to one another. As shown, after wrapping around the outside surface of the tip insert member 30*b*, a main string segment 40*a* extends through the right hand side of string port hole 32*a* to the throat bridge 14. There, string segment 40*a* extends through the left hand side of the string port hole 32*b* in the throat bridge 14 and wraps around the outside of the throat bridge 14. The next string segment 40*b*, after passing through the right-hand side of port string hole 32*c*, extends from the throat bridge 14 through the left-hand side of the string port hole 32*a* in the insert member 30*b*, wraps around the outside of the insert 30*b*, and extends through the right-hand side of the next string port hole 32*d*.

Several of the outer main string segments 40*c* extend through the forked opening 36 in the throat bridge 14 to string holes in the insert members 30, 30*a*. As shown, the saddle shaped base 38 of the forked opening 36 provides a seat for one of the string segments 40*d*.

Figure 7:
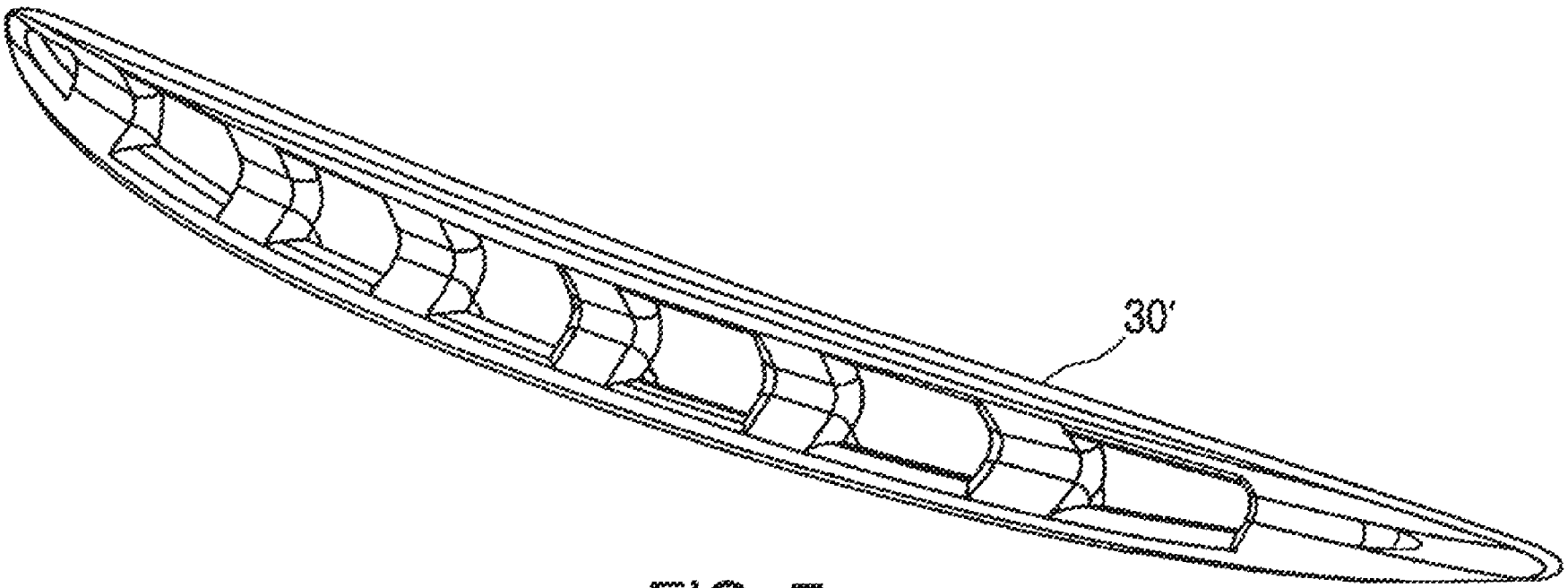
FIG. 7 is a perspective view of an insert member for use in the racquet frame shown in FIGS. 4-6.
Figure 8:
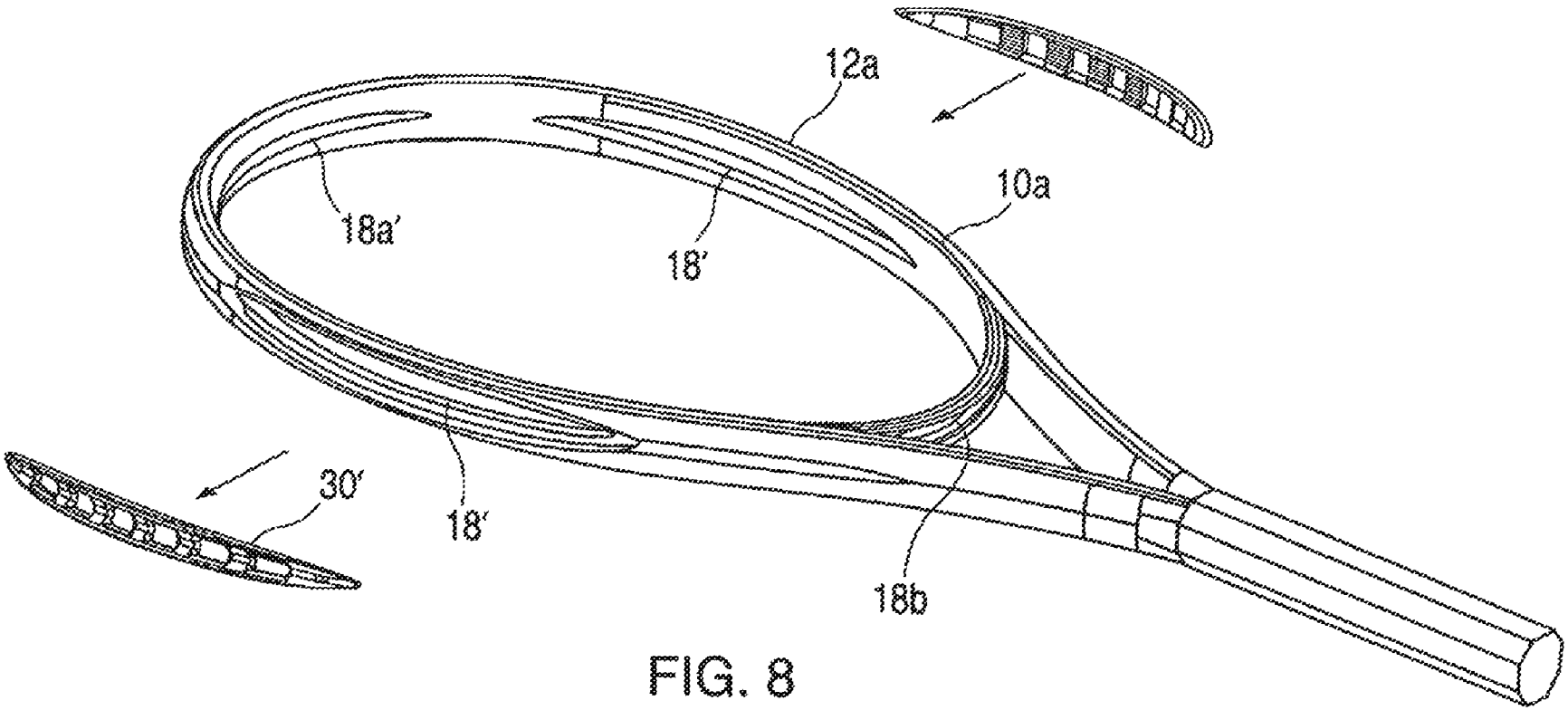
FIG. 8 is a view similar to FIG. 4 but also showing the insert members.

FIGS. 4-8 illustrate a second embodiment of the invention. The opposite sides of the head portion 12*a* of the frame 10*a* include cutout portions 18', and the tip region includes a cutout portion 18*a*', each for receiving a cutout member. In addition, the throat bridge 14*a* includes a cutout portion 18*b* for receiving another insert member. As shown, the cutout portions 18', 18*a*' are not as long as the cutout portions 18, 18*a* in FIGS. 1-3, and some of the string holes would be drilled or formed in the frame 10*a* in the regions between the cutout portions. FIG. 7 shows another example of a insert member 30', which is received in one of the cutout portions 18', with corresponding insert members being received in the other cutout portions.

Figure 9:
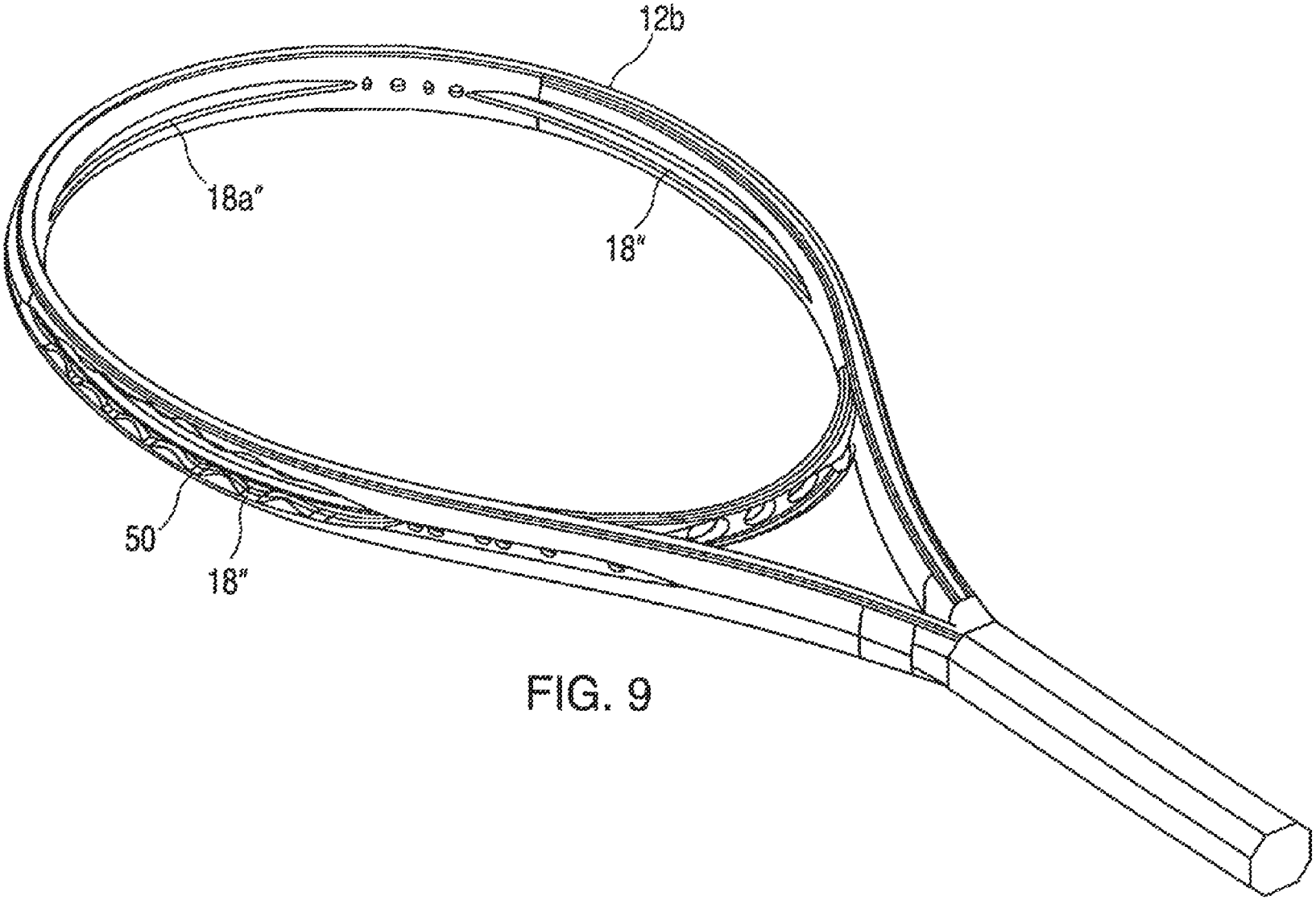
FIG. 9 is a perspective view of a racquet frame according to a third embodiment of the invention.
Figure 10:
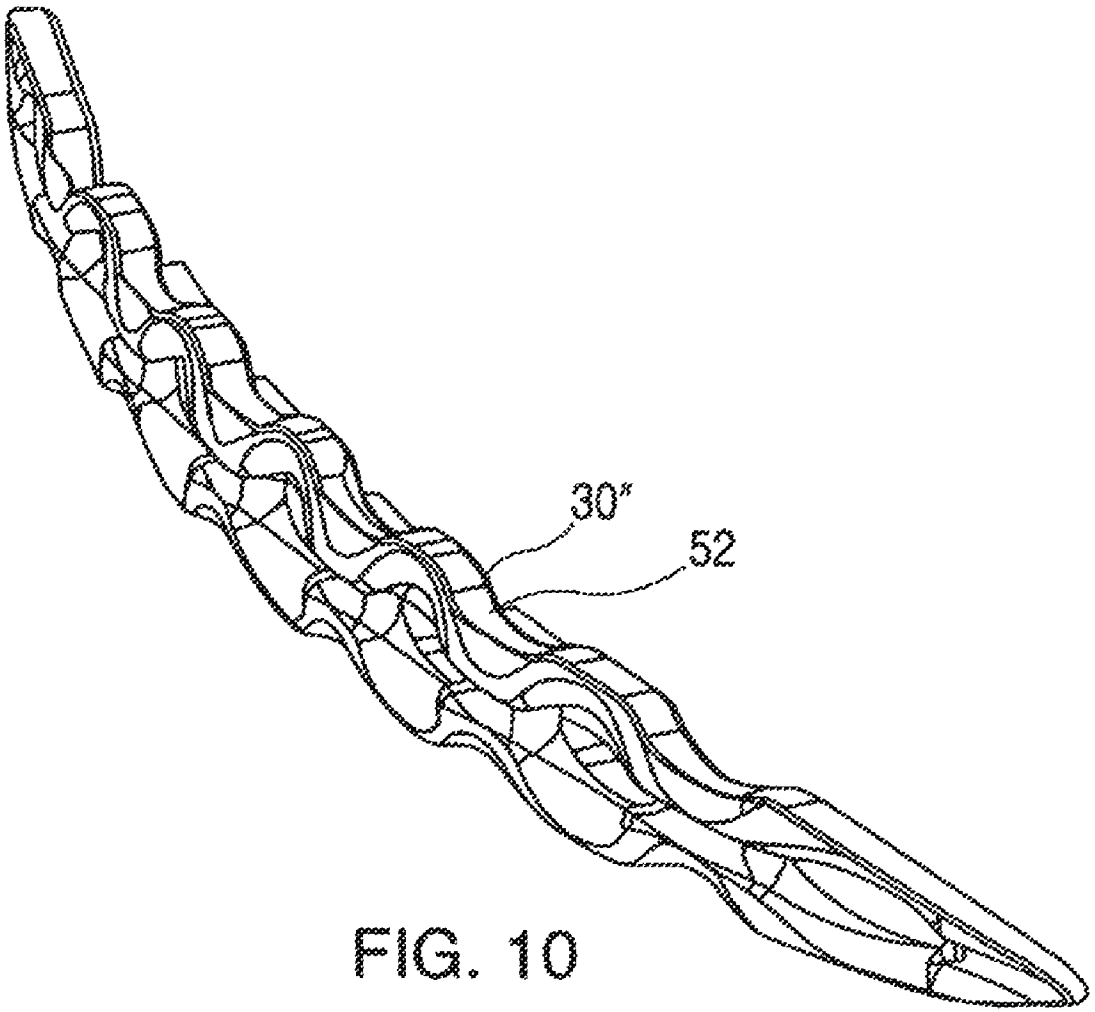
FIG. 10 is a perspective view of an insert member for use with the frame of FIG. 9.

FIGS. 9-10 show a third embodiment in which the inwardly facing walls 50 of the cutout portions 18", designed to receive insert members, have an undulating shape. As shown in FIG. 10, the insert members 30" have undulating side walls 52 to fit in the cutout portions 18".

Figure 11:
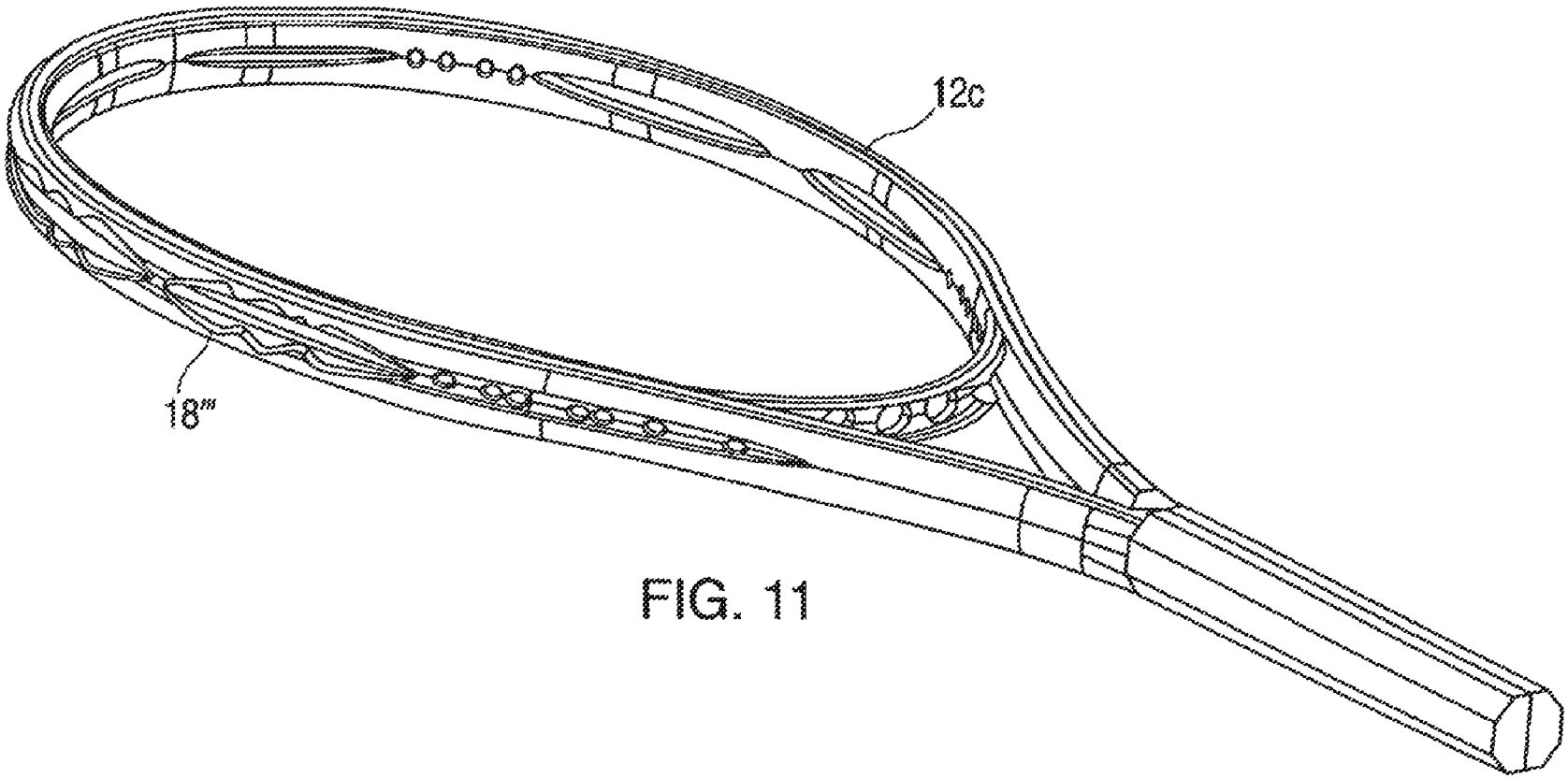
FIG. 11 is a perspective view of a racquet frame according to a fourth embodiment of the invention.
Figure 12:
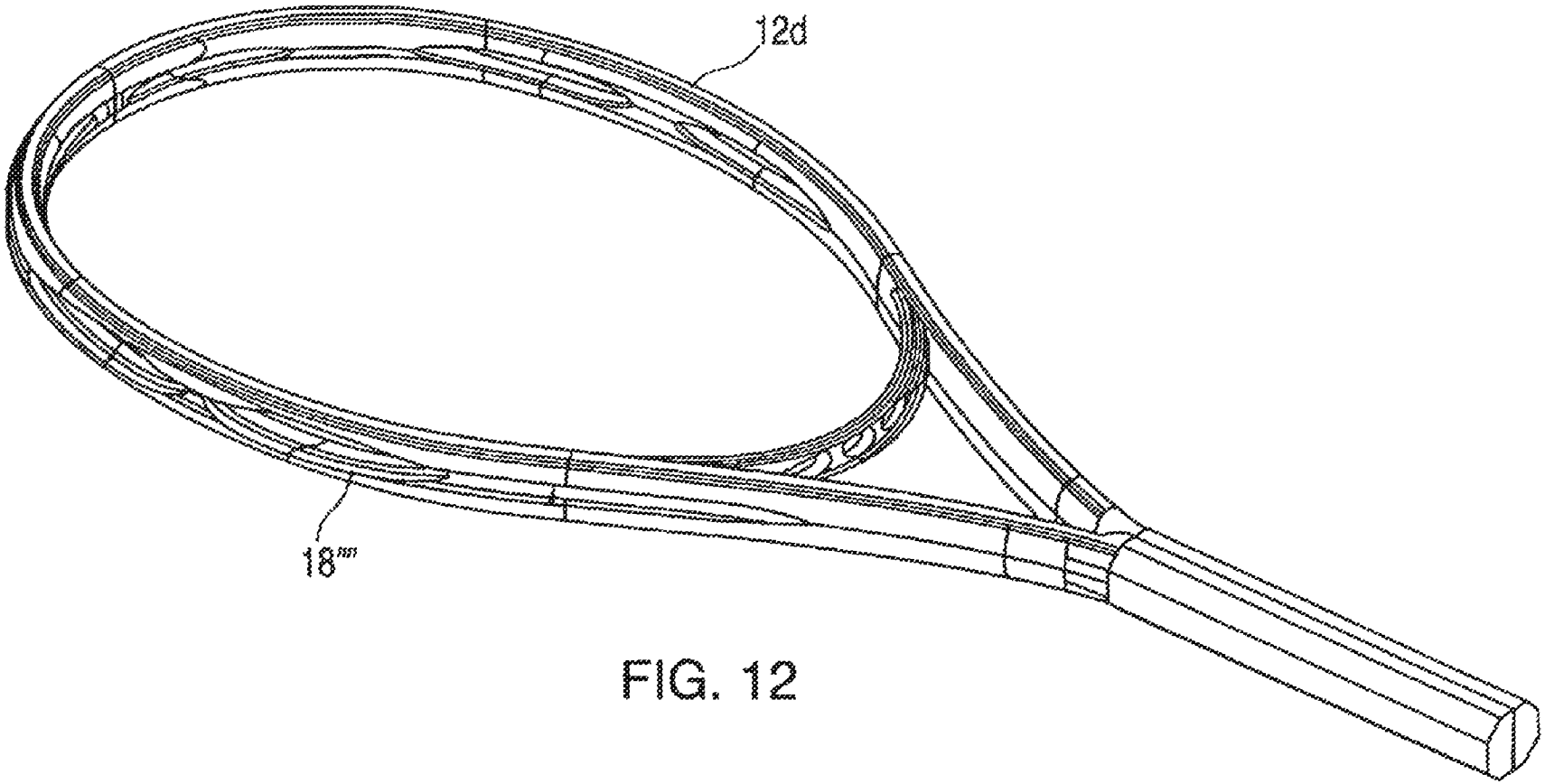
FIG. 12 is a perspective view of a racquet frame according to a fifth embodiment of the invention.

FIGS. 11-12 show two more embodiments of the invention, in which the sides and tip of the head portion 12*c* and 12*d* each have more than one cutout portion 18''' and 18''''. In the case of FIG. 11, the inwardly facing walls 50*c* of the cutouts 18''' are smooth, whereas in FIG. 12 the walls 50*d* are undulating.

Figure 13:
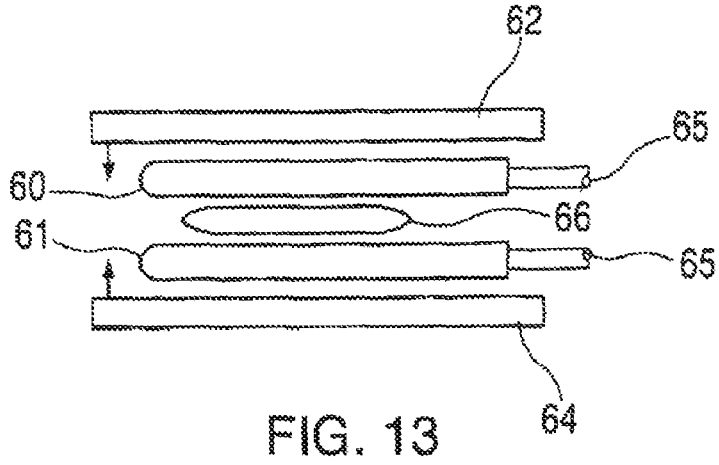
FIG. 13 is a schematic drawing of a molding process for forming a racquet according to the invention.

Preferably, the racquet frame is formed in accordance with a process similar to that described in U.S. published patent application No. US2003/0162613, which is incorporated herein by reference. As shown schematically in FIG. 13, a pair of hollow prepreg tubes 60, 61 of uncured composite material are placed between upper and lower mold halves 62, 64 which, when closed, define an inner mold cavity in the shape of the racquet frame. An inflatable bladder member 65 extends through each prepreg tube. Each bladder member 65 has a pair of ends that project out of the mold when the mold is closed.

Prior to closing the mold, mold members 66, in the desired shape of the cutout portions, are positioned between the upper and lower tubes 60, 61, in the locations where the cutout portions are desired. The mold is then closed, and the bladders 65 are inflated such that the prepreg tubes 60, 61 assume the shape of the mold and the insert members 66. At the same time, the mold is heated in order to cause the composite material to cure.

During molding, the abutting walls of the upper and lower tubes 60, 61 fuse together to form a common interior wall in the string bed plane, except where the mold members 66 keep the walls separated from one another. After molding, the mold members 66 are withdrawn from the frame, leaving the cutout portions.

A racquet according to the invention can also be made according to the processes described in U.S. Pat. No. 6,071,203. Such racquet frame also is formed of a pair upper and lower tube halves. However, the tubular frame halves are molded individually and then glued together.

If desired, a racquet according to the invention can be made by other methods. For example, the frame can be molded from a single tube of prepreg, using an inflation molding process similar to a conventional inflation molding process. As in a conventional process, an inflatable bladder is inserted into a prepreg tube, whereupon the tube is inserted into a mold having the desired shape of the frame, The tube is then inflated to conform to the shape of the mold, as the prepreg material is cured.

Figure 14:
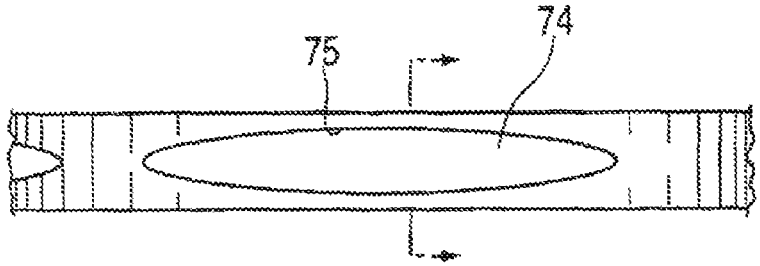
FIGS. 14 and 15 are side and cross-sectional views of a portion of a racquet frame manufactured according to an alternate molding process.
Figure 15:
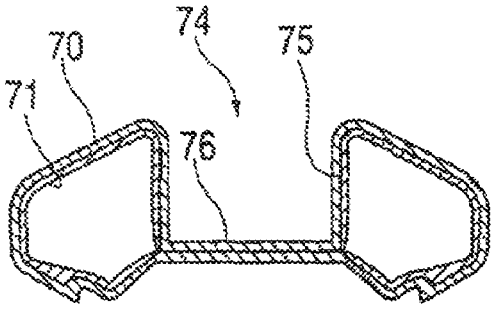
Figure 16:
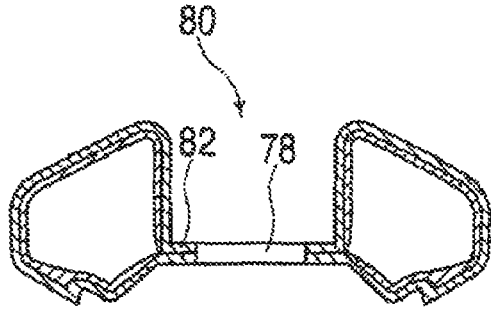
FIG. 16 illustrates the racquet frame of FIGS. 14-15 after the formation of cutout portions has been completed.

Referring to FIGS. 14-16, to make a racquet according to the present invention, a hollow prepreg tube 70, with an inflation bladder 71 therein, is placed in a mold shaped to define cutout blanks 74 with side walls 75 in the shape of cutouts for receiving inserts. As shown, the cutout blanks 74 have a bottom wall 76 formed where opposite sides of the prepreg tube 70 have been fused together during the molding process. After the racquet frame has been removed from the mold, slots 78 are drilled to form finished cutout portions 80. The slots 78 are drilled so as to leave an outwardly facing shoulder 82 which can form a bearing surface for the insert members (not shown).

Alternatively, the frame can be formed by injection molding of composite material containing short, chopped fibers, in accordance with another known process, which allows the cutouts to be molded in directly, without the need to remove a blocking wall after molding. In the case of racquets made of metal, the frame can be formed in a conventional manner, e.g., by extruding the frame, and then drilling the string holes and enlarged string holes.

Finally, if desired the frame can be made using a double bladder. In regions where the cutouts are to be present, a prepreg tube is formed around each bladder. In other sections of the frame, both bladders extend through the interior of a common tube. Where the cutouts are to be formed, insert mold members are inserted between the two prepreg tube sections, and then the frame is formed by inflation molding in a conventional manner.

As used herein, the term "sides" refers generally to the regions of the racquet head between the upper and lower corners, and the "tip" refers generally to the region of the head between the upper corners. However, since these terms are not terms of art, "sides" and "tip," as used herein, can include any portion of the sides or tip, or even include a portion of persons might consider to be the corners.

The foregoing represent preferred embodiments of the invention. Variations and modifications will be apparent to persons skilled in the art, without departing from the inventive concepts disclosed herein. For example, while in the preferred embodiment the shoulder 24 forming a seat for the insert member is perpendicular to the string, other shapes can be used. For example, the cutout portions can have walls which taper in the direction of the string bed, with the insert members also having tapering walls. The force of the strings, when tensioned, will ensure that the insert member is firmly retained in the cutout portion.

Another possibility is to mold the carbon fiber frame of the racquet jointly with pre-formed inserts placed in the mold. In this embodiment, the insert cannot be removed from the frame. However, this embodiment would avoid the need for expensive equipment to form the insert with tolerances ensuring a tight fit in the frame openings, in that the frame will adapt to the shape of the inserts. The inserts, which can be made of plastic, metal, carbon fiber composites, wood, ceramic, etc., are placed into the mold, at the desired locations, with the prepreg tube. When the prepreg tube is heated and expanded, the epoxy or thermoplastic resin will bond firmly with the insert to retain it permanently in place.

The characteristics of the insert can be selected based on the choice of materials. If the insert is plastic, features such as damping, soft hitting feeling, etc., can be realized. If the insert is made of other materials, different characteristics, such as elasticity, will result. All such modifications and variations are intended to be within the scope of the invention, as defined in the following claims.

The invention claimed is:

1. In a sports racquet comprising:

a tubular frame including a head portion defining a stringing area and a handle portion coupled to said head portion;

a first set of string segments extending at least generally parallel to one another in a first direction; and a second set of string segments extending at least generally parallel to one another in a second direction which is at least generally perpendicular to said first direction, said first and second set of string segments being interwoven to form a string bed lying generally in a string bed plane;

the improvement wherein said head portion includes a cutout portion that includes a seat surface, and wherein said racquet further comprises an insert member having at least one string port formed therein, having an axis at least generally parallel to said string bed plane, with opposed first and second bearing surfaces for receiving a pair of string ends of said first set of string segments, respectively, to provide a predetermined spacing between said string segments, and a third bearing surface to engage said seat surface to counter the pulling force of the strings when tensioned.

2. A sports racquet as defined in claim 1, wherein said head portion includes a pair of opposed sides, wherein each side includes a cutout portion and corresponding insert member, and wherein the string ports of insert members on opposite sides of the string bed are offset relative to one another such that a string segment adjoining one bearing surface of one string port, after crossing the string bed, bears against the opposite bearing surface of another string port.

3. A sports racquet according to claim 2, wherein each insert member includes a plurality of string ports.

4. A sports racquet as defined in claim 3, wherein said head portion includes a tip region having a cutout portion and corresponding insert member.

5. A sports racquet as defined in claim 4, wherein said head portion includes a throat bridge having at least one string port formed therein, said string port being offset relative to a string port of the insert member in the tip region.

6. A sports racquet as defined in claim 5, wherein the throat bridge has a pair of ends, each end comprising a pair of end portions with a space therebetween lying in said string bed plane to allow at least one string to pass through.

7. A sports racquet as defined in claim 3, wherein said head portion includes a throat bridge having at least one string port formed therein, said string port being offset relative to a string port of the insert member in the tip region.

8. A sports racquet as defined in claim 7, wherein the throat bridge has a pair of ends, each end comprising a pair of end portions with a space therebetween lying in said string bed plane to allow at least one string to pass through.

9. A sports racquet according to claim 1, wherein said insert member further includes at least one string hole for receiving an end of another string of said first set of string segments.

10. A sports racquet as defined in claim 1, wherein said head portion includes a tip region which includes a cutout portion and corresponding insert member.

11. A sports racquet according to claim 10, wherein each insert member includes a plurality of string ports.

* * * * *